United States Patent [19]
Scribner
[11] 4,243,869
[45] Jan. 6, 1981

[54] FUSING DEVICE FOR ELECTROSTATIC COPIER

[75] Inventor: Albert W. Scribner, Darien, Conn.
[73] Assignee: Pitney Bowes, Inc., Stamford, Conn.

[21] Appl. No.: 39,473
[22] Filed: May 16, 1979
[51] Int. Cl.³ ..... H05B 1/00; G03G 15/00
[52] U.S. Cl. ..... 219/216; 219/469; 432/60; 432/228
[58] Field of Search ..... 219/216, 469–471; 432/59, 60, 227, 228; 355/3 FU; 250/317–319

[56] References Cited

U.S. PATENT DOCUMENTS

| | | | |
|---|---|---|---|
| 3,202,818 | 8/1965 | Thomiszer | 219/216 X |
| 3,637,976 | 1/1972 | Ohta et al. | 219/469 |
| 3,920,328 | 11/1975 | Toto et al. | 219/216 X |
| 3,980,863 | 9/1976 | Wulz et al. | 219/216 |
| 4,132,882 | 1/1979 | Endo et al. | 219/216 |

*Primary Examiner*—C. L. Albritton
*Attorney, Agent, or Firm*—Lawrence E. Sklar; William D. Soltow, Jr.; Albert W. Scribner

[57] ABSTRACT

A fusing apparatus for an electrostatic copier has a flexible web rotatably driven between first and second pressure fixing rollers that are further supported by a rotatable, third pressure roller substantially in contact with the web and the second pressure fixing roller. Only the web is heated in an area just prior to the first pressure fixing roller. The entrapped copy sheet follows a concave path formed by the web and the first pressure fixing roller outer diameter, during which time the toner is gradually melted until it is finally pressed and fixed on the copy sheet by the first and second pressure fixing rollers.

15 Claims, 2 Drawing Figures

FUSING DEVICE FOR ELECTROSTATIC COPIER

BACKGROUND OF THE INVENTION

The present invention relates to electrostatic copiers, and more particularly to fusing electrostatic toner material to the surface of a copy sheet bearing toner. There are a number of well known devices that fuse or fix toner material to copy sheets by applying a combination of heat and pressure to a toner bearing copy sheet through a pair of relatively rigid rollers, one or both of which are internally heated in order to soften and thereby fuse the toner to the copy sheet. Other means and devices externally heat one or both rollers which are coated with special, thermally conductive, elastomeric material.

Still another device passes the copy sheet through the nip of a feed roller and thermally transparent, rigid drum. Inside the drum are a radiant energy lamp and a reflector which focuses the thermal energy on a line transverse to the direction of sheet travel. One such device is described in U.S. Pat. No. 3,452,181.

Heat assisted fusing devices pose a potential fire hazard in the event of either a sheet jam or mechanical component failure within the fuser. Failure to eject a fused copy sheet from the fixing rollers is normally detected by suitable jam sensing means. Such detector systems usually sense the interruption of the normal copy paper sheet flow through the fusing system. Any abnormal signal resulting from improper sheet flow to, through, or from the fusing station provides the jam detection system with a signal to shut down the fuser heating source. However, even when the jam detector system functions properly, the large thermal masses comprising the desired fusing devices may retain sufficient thermal energy to ignite any inadvertently jammed copy sheet or the like. Similarly, a focused energy source from a lamp could also readily ignite a jammed copy sheet before the lamp is extinguished and the resulting heat harmlessly dissipated.

Other problems associated with heated roller fusing devices are found with the tendency of the fused copy sheet to stick to the heated roller fusing surface immediately after the fusing process has been completed at the pressure roller pair. The internally heated rollers associated with present fusers are normally several inches or more in outside diameter. Unfortunately, this relatively large size associated with the heated rollers provides an opportunity for the fused copy sheet to naturally adhere to the roller surface due to slightly tacky toner material still warm from heat transfer. If even one sheet of copy paper sticks to the heated roller surface by virtue of slightly tacky toner, a potential fire hazard looms. Also, the fire hazard increases with the possible accumulation of fuel added by a stream of copy sheets being fed through the copier at relatively high lineal velocities. Accordingly, there have been many attempts to provide adequate jam sensing devices for copy sheets moving towards, through, and away from fusing devices. There has been additional effort directed at providing fire extinguishing means in many of the previous fusing devices known in the field today. However, a relatively high likelihood of fire hazard remains with the use of these fusing devices in the event of mechanical malfunction or paper jam occurences.

SUMMARY OF THE INVENTION

The instant invention overcomes the forgoing problems by providing a fusing apparatus and method for applying pressure and heat to an unfused copy sheet bearing a developed electrostatic image on at least one surface thereof in order to fuse the image on the copy sheet. The fusing apparatus comprises first and second, oppositely driven, mutually biased, pressure fixing feed rollers, and a third roller laterally supporting the first and second pressure fixing rollers and driven oppositely from the second, pressure fixing feed roller. The apparatus also includes a flexible, thermally conductive web for contacting the image bearing surface of the copy sheet, the web being disposed about and contacting a portion of the first roller and passing through a first nip defined by the first and second rollers, and wherein the web is further disposed about and contacts the portion of the second roller between the first nip and a second nip defined by the second and third rollers in an opposite direction from the contact with said first roller. The area of contact between the web and the first roller defines a concave path for the unfused copy sheet. The apparatus also includes means for heating only the web, whereby when the unfused copy sheet is fed between the heated web and the first roller, the developed image on the copy sheet is gradually melted until the image is finally pressed and fixed on the copy sheet by passing between the first and second pressure fixing rollers.

DETAILED DESCRIPTION

Figure 1:
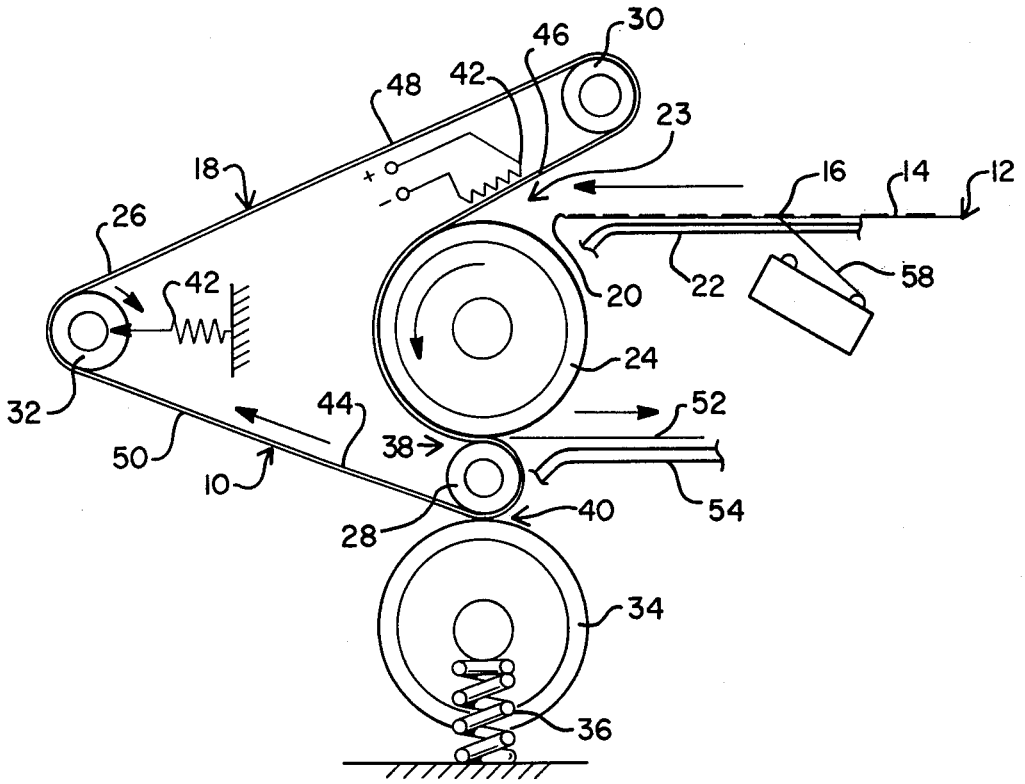
FIG. 1 is an elevational view of a fuser for an electrostatic copier in accordance with the instant invention.

Referring to FIG. 1, a fuser 10 is generally shown together with a carrier or copy sheet 12. On one surface 14 of the copy sheet 12, an unfixed image 16 has been previously formed of toner particles that are lightly held to the copy sheet surface 14 by slight electrostatic forces. The unfused copy sheet 12 is guided and positioned by appropriate means (not shown) so that the unfused, residing toner image 16 directly faces the heated, moving, endless metal web 18. The unfused copy sheet 12 is guided by an appropriate rigid member 22, which is part of the copier structure and framework, so that the lead edge 20 of the sheet 12 is guided to the nip 23, defined by the tubular steel primary pressure roller 24 and the heated metal web 18. The external surface 26 of the web 18 and the relatively low tangent angle defined by the web 18 and the roller 24 provide a gentle, paper receiving means located at the nip 23. The gentle handling of the copy sheet 12 thus provides minimal disruption to the unfused image 16 at the fuser entrance.

The web 18 is fabricated from a suitable, flexible, 0.006 inch to 0.008 inch thick, stainless steel strip. The ends of the strip are appropriately aligned and butt-welded to form a smooth and essentially seamless joint suitable for smooth, constant and uninterrupted motion under frictional urging by driving cylinders. Steel rollers 28, 30 and 32 are rotatable, tubular and 0.500 inch in outer diameter. Roller 28 functions as a pressure roller, lying between primary pressure roller 24 and a similar supportive roller 34. The rollers 24, 28, 30, 32 and 34 are all suitably suspended in end journals appropriate for driven and idling rotating rollers. Rollers 24 and 34 are steel, tubular and 1.500 inches in outer diameter. Compression springs 36 engage the end journals of the supportive roller 34 thereby providing a biasing force to the roller stack consisting of rollers 24, 28, and 34. The supportive roller 34 is appropriately aligned with the rollers 24 and 28 in order to provide a uniform lateral pressure at the nip points 38 and 40, formed respectively by the rollers 24 and 28 and the web 18, and the rollers 28, 36 and the web 18. The web 18 is supported internally by the rotatable, spring loaded roller 32 and the idler roller 30. The roller 32 is acted upon at its suspending journal by appropriate compression springs 42 which provide web tension for maintaining the loop encompassed by the web 18. Motion is supplied to the web 18 by means of driving the driven rotating pressure rollers 24 and 28 in opposing directions by a suitable gear train applied to their respective ends and in engagement with a driving gear on roller 24 in order to provide a positive motion to rolls 28 and 34. Accordingly, a suitable master drive to the entire fuser is accomplished by a suitable positive connection of a timing chain or timing belt at one end of the primary pressure roller 24. The large complementary angle defined in the concave wrap between the roller 24 and the steel web 18 is sufficient to ensure a positive frictional drive for the web 18. Additional positive pull to the web 18 is supplied through the wrap of the web 18 about the roller 28 and through the pressure nip points 38 and 40.

In the normal course of operation of a copier machine, those skilled in the art will recognize that the fuser comprisint the invention is driven in an endless fashion by appropriate drive motors, motion transmitting devices and connecting means associated with a copier machine commanded by an operator to deliver single or multiple copies.

A 115V AC supplied heating element 42, consisting of a resistance coil, is disposed inside the loop defined by the suspended web 18. The heater coil 42 is conveniently located prior to the copy sheet entrance nip 23, and is suspended from the structure comprising the fuser in an area encompassed by the web 18 so as to provide heat to the internal surface 44 of the web at two spaced locations, 46 and 48 adjacent to coil 42.

The heater coil 42 is arranged so that it is closer to the location 46 of the web 18 that is just prior to the entrance nip 23. Residual heat generated by the coil 42 additionally is transferred by convection to the web location 48. It should be noted, however, that the heater coil 42 could be situated outside the web 18 so as to heat the external web surface 50.

Due to the low thermal mass of the web 18, the heat applied by the resistance coil 42 to the inner web surface 44 is rapidly transferred by conduction to the external web surface 50. As the web 18 is caused to move according to the driven, rotating rollers 24, 28 and 34, the resistance coil 42 indirectly heats the external web surface 50 so that the temperature of the web surface surface 50 is at a sufficiently elevated level for melting the toner 16. Copy sheets 12 with unfused toner 16 arrive at the nip 23, where the toner 16 immediately contacts the heated external web surface 50 and subsequently becomes progressively molten while the copy sheets 12 follow the concave path about the primary pressure roller 24 and proceed towards the primary pressure nip 38. The molten toner images 16 are finally pressed into the copy sheet 12 at the pressure nip 25 by the roller pressure exerted at that point on the sheet 12, toner 16 and web 18.

The web 18 assumes a directional path change immediately upon leaving the primary pressure nip 38 where the web is caused to bend reversibily around the smaller pressure roller 28. The inner web surface 44 engages the outer diameter of the roller 28 circumferentially from the pressure nip 38 to the pressure nip 40. The fused copy sheet 52 leaves the pressure nip 38 and is guided by an appropriately placed sheet guide chute 54 in order to be delivered to a machine operator at a copy exit point suitably located to that end.

The smooth ejection of the fused copy sheet 52 is assured by the geometry and relationship defined by the pressure roller 28, which, being three times smaller than its partner pressure roller 24, presents a geometric shape that a copy sheet would have great difficulty in following beyond the pressure nip 38. Those skilled in the art will immediately recognize that the natural tendency of copy sheet material to return to a flattened shape will prevent a fused sheet from bending reversibily 180 through the path circumscribed by the web 18 between the nips 38 and 40. Thus, no additional release agents, such as silicone oil or elastomer impregnated with silicone oil, are required to ensure release of the fused copy sheet 52 from the nip 38.

Figure 2:
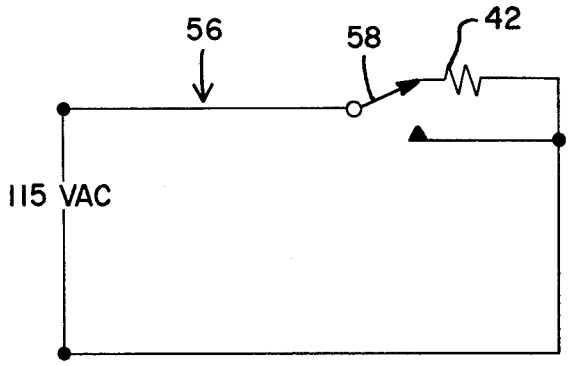
FIG. 2 is a schematic diagram of the electrical controls for the fuser shown in FIG. 1.

In order to conserve energy, the resistance coil heater 42, seen in FIG. 1 and schematically shown in FIG. 2, is operated by a control system 56. A switch 58 is operatively disposed in the path of the unfused copy sheets 12. The switch 58 is closed when the leading edge of the unfused sheet 12 engages and operates switch arm 60, thereby allowing sufficient time to energize the resistance heater 42 and bring the moving web 18 to a sufficiently elevated temperature. When the trailing edge of the unfused copy sheet 12 leaves the switch arm 60, the switch 58 is returned to its open position by its bias. The resistance coil 42 is subsequently turned off, and additional, oncoming, unfused sheets 12 arriving at the switch 58 will repeat the cycle according to demand from the machine operator. Those skilled in the art will recognize that a jam detection, electrical sensing system can be incorporated into the electrical sensing apparatus in order to monitor the passage of unfused copy sheets through the fuser 10. Electrical power to the resistance coil heater 42 would be terminated if a copy sheet has not passed through the fuser 10 in a predetermined amount of time.

Additionally, those skilled in the art of handling sheet material through fusers will recognize that the compression springs 36 are adaptable for providing varying amounts of force necessary to increase or reduce the pressure required for fixing the copy sheet at the pressure nip point 38. Also, the previously described means of gear drive associated with rollers 24, 28, and 34 is not influenced by the separation of those rollers in allowing passage of copy sheets through the respective pressure nips, since the gear teeth, having standard tooth-space geometry, allow radial motion of the rollers between each other regardless of the thickness of the copy sheet material or web clamped therebetween. It will also be recognized that the frictional drive generated by all moving members, defined by the web 18, and rollers 24, 28 and 34 generates sufficiently frictional forces to deliver the copy sheets in their fused and finished form in a proper and constant flow to the copier sheet exit station (not shown).

The relative thinness of the web 18 is utilized in rapidly transferring heat from the resistive coil 42 to the unfused toner 16. Also, the heat in the web 18 is quickly dissipated, owing to the thinness of the web, in order to prevent the copy sheet from igniting due to an inadvertent paper jam in the roller nip areas 23, 38 and 40.

It should be noted that the instant invention may be employed in copiers that use either a direct or indirect means for forming a toner image on the copy sheet. Hence, it is useful in the so-called plain paper as well as coated paper copiers. Further, the invention is also adaptable to fixing images to other heat fusible surfaces, such as plastic and cloth.

Needless to say, further supportive rollers for extending the web 18 are possible, and additional heaters may be placed appropriately within the loop described by alternate geometry of the web.

What is claimed is:

1. A fusing apparatus for applying pressure and heat to an unfused copy sheet bearing a developed electrostatic image on at least one surface thereof in order to fuse the image on the copy sheet, comprising:

first and second, oppositely driven, mutually biased, pressure fixing feed rollers:

a third roller laterally supporting the first and second pressure fixing rollers and driven oppositely from said second roller;

a flexible, thermally conductive web for contacting the image bearing surface of said copy sheet, said web disposed about and contacting a portion of said first roller and passing through a first nip defined by the first and second rollers, said web being further disposed about and contacting the portion of the second roller between the first nip and a second nip defined by the second and third rollers in an opposite direction from the contact with said first roller, wherein the area of contact between the web and the first roller defines a concave path for the unfused copy sheet; and means for heating only said web, whereby when the unfused copy sheet is fed between said heated web and said first roller, the developed image on the copy sheet is gradually melted until said image is finally pressed and fixed on the copy sheet by passing between the first and second pressure fixing rollers.

2. The apparatus of claim 1 wherein the second pressure fixing roller is smaller in diameter than the first pressure fixing roller.

3. The apparatus of claim 2 wherein the heating means is operatively disposed adjacent the surface of the web that contacts the unfused copy sheet.

4. The apparatus of claim 2 wherein the heating means is operatively disposed adjacent the surface of the web that does not contact the unfused copy sheet.

5. The apparatus of claim 4 wherein the heating means comprises a resistance coil situated to provide heat to two spaced locations, each of said locations being adjacent said resistance coil.

6. The apparatus of claim 4 wherein the web comprises a flexible strip of stainless steel 0.006to 0.008 inch thick.

7. The apparatus of claim 4 wherein the diameters of the first and second pressure fixing rollers are respectively 1.5 and 0.5 inches.

8. The apparatus of claim 4 wherein the web comprises an endless loop.

9. The apparatus of claim 4 wherein the web is reversibly bent 180 degrees around the second, pressure fixing roller.

10. The apparatus of claim 4 wherein the web contacts about one half the circumference of the first pressure fixing roller.

11. A method of applying pressure and heat to a developed electrostatic image on the surface of a copy sheet in order to fix the image to the surface, comprising:

providing first and second, oppositely driven, mutually biased, pressure fixing feed rollers, and a third roller laterally supporting the first and second pressure fixing rollers;

contacting a portion of said first roller with a thermally conductive, flexible web, said web passing through a first nip defined by the first and second rollers;

contacting the second roller with said web between the first nip and a second nip defined by the second and third rollers in a opposite direction from the contact with the first roller; and feeding said copy sheet between said web and said first pressure fixing roller so that the image bearing surface of the copy sheet contacts the web, whereby the developed image on the copy sheet is gradually melted until said image is finally pressed and fixed on the copy sheet by the pressing action of the first and second pressure fixing rollers.

12. The method of claim 11, wherein the web is reversibly bent 180 degrees around the second, pressure fixing roller.

13. The method of claim 12 wherein the web is heated before it contacts the copy sheet.

14. The method of claim 13, wherein the web is heated on the surface thereof that contacts the unfused copy sheet.

15. The method of claim 13, wherein the web is heated on the surface thereof that does not contact the unfused copy sheet.

* * * * *